US010794099B2

(12) United States Patent
Chen et al.

(10) Patent No.: US 10,794,099 B2
(45) Date of Patent: Oct. 6, 2020

(54) FIXING STRUCTURE OF DOOR BODY SHAFT BUSHING AND DRUM WASHING MACHINE

(71) Applicant: QINGDAO HAIER DRUM WASHING MACHINE CO., LTD., Laoshan District Qingdao, Shandong (CN)

(72) Inventors: Yongchao Chen, Shandong (CN); Kai Zhu, Shandong (CN); Yanhua Li, Shandong (CN); Yanli Wang, Shandong (CN)

(73) Assignee: Qingdao Haier Drum Washing Machine Co., Ltd., Shandong (CN)

( * ) Notice: Subject to any disclaimer, the term of this patent is extended or adjusted under 35 U.S.C. 154(b) by 202 days.

(21) Appl. No.: 16/071,865

(22) PCT Filed: Jan. 20, 2017

(86) PCT No.: PCT/CN2017/071940

§ 371 (c)(1),
(2) Date: Jul. 20, 2018

(87) PCT Pub. No.: WO2017/125074

PCT Pub. Date: Jul. 27, 2017

(65) Prior Publication Data

US 2019/0024289 A1 Jan. 24, 2019

(30) Foreign Application Priority Data

Jan. 20, 2016 (CN) ..... 2016 1 0038044

(51) Int. Cl.

| | |
|---|---|
| ***E05D 5/14*** | (2006.01) |
| ***D06F 37/28*** | (2006.01) |
| ***E05D 5/16*** | (2006.01) |

(52) U.S. Cl.
CPC ..... *E05D 5/14* (2013.01); *D06F 37/28* (2013.01); *E05D 5/16* (2013.01); *E05Y 2600/53* (2013.01); *E05Y 2900/312* (2013.01)

(58) Field of Classification Search
None
See application file for complete search history.

(56) References Cited

U.S. PATENT DOCUMENTS

2005/0017612 A1* 1/2005 Park ..... D06F 39/14 312/326
2007/0256459 A1* 11/2007 Yoon ..... D06F 37/28 68/139

(Continued)

FOREIGN PATENT DOCUMENTS

CN 101812795 A 8/2010
CN 202023082 U 11/2011

(Continued)

OTHER PUBLICATIONS

International Search Report and Written Opinion dated Apr. 26, 2017, regarding PCT/CN2017/071940.

*Primary Examiner* — Marcus Menezes
(74) *Attorney, Agent, or Firm* — Arent Fox LLP

(57) ABSTRACT

A fixing structure of a door body shaft bushing includes a door body outer frame, a door body inner frame engaged with the door body outer frame, a door body shaft bushing arranged between the door body outer frame and the door body inner frame, and a plurality of reinforcing ribs arranged on two opposed surfaces of the door body outer frame and the door body inner frame when the door body outer frame and the door body inner frame are engaged with each other. The plurality of reinforcing ribs are respectively arranged in a staggered manner along a radial direction and an axial direction of shaft holes of the door body shaft bushing. The reinforcing ribs on the door body outer frame and/or the door (Continued)

body inner frame are in contact with the door body shaft bushing and clamp the door body shaft bushing.

16 Claims, 8 Drawing Sheets

(56) References Cited

U.S. PATENT DOCUMENTS

| | | | | |
|---|---|---|---|---|
| 2013/0002113 | A1* | 1/2013 | Loss | D06F 58/04 312/291 |
| 2013/0234573 | A1* | 9/2013 | Coxon | E05D 9/005 312/228 |
| 2016/0076187 | A1* | 3/2016 | Lee | E05D 7/1055 312/228 |
| 2018/0142399 | A1* | 5/2018 | Chun | D06F 34/10 |
| 2018/0216282 | A1* | 8/2018 | Lee | D06F 37/28 |
| 2019/0145041 | A1* | 5/2019 | Bhandare | D06F 33/00 68/196 |

FOREIGN PATENT DOCUMENTS

| | | | | |
|---|---|---|---|---|
| CN | 104567218 | A | 4/2015 | |
| DE | 4239038 | A1 * | 5/1994 | D06F 37/28 |
| EP | 1762650 | A2 * | 3/2007 | D06F 37/28 |
| EP | 2147996 | A1 * | 1/2010 | D06F 39/14 |
| EP | 2455536 | A1 * | 5/2012 | D06F 39/14 |
| EP | 2843110 | A1 * | 3/2015 | D06F 39/14 |
| EP | 2868795 | A1 * | 5/2015 | H01R 27/00 |
| EP | 3034677 | A1 * | 6/2016 | D06F 37/28 |
| EP | 3358068 | A1 * | 8/2018 | D06F 33/00 |
| JP | H05059885 | U | 8/1993 | |
| JP | H08130382 | A | 5/1996 | |
| JP | 2010273965 | A | 12/2010 | |
| KR | 20060085831 | A | 7/2006 | |
| KR | 20110013007 | A | 2/2011 | |
| WO | WO-2015165521 | A1 * | 11/2015 | D06F 39/14 |
| WO | WO-2016070889 | A1 * | 5/2016 | D06F 39/14 |
| WO | WO-2017018710 | A1 * | 2/2017 | D06F 37/28 |
| WO | WO-2018033057 | A1 * | 2/2018 | D06F 37/28 |

* cited by examiner

B-B

FIXING STRUCTURE OF DOOR BODY SHAFT BUSHING AND DRUM WASHING MACHINE

CROSS-REFERENCES TO RELATED APPLICATIONS

This is a National Stage Application, filed under 35 U.S.C. 371, of International Patent Application No. PCT/CN2017/071940, filed on Jan. 20, 2017, which claims priority to Chinese patent application No. 201610038044.2 filed on Jan. 20, 2016, contents of both of which are incorporated herein by reference in their entireties.

TECHNICAL FIELD

The present disclosure relates to the technical field of fixation of door body shaft bushings, and for example, relates to a fixing structure of a door body shaft bushing and a drum washing machine.

BACKGROUND

A drum washing machine in a related art generally has a door body. The door body is connected with a machine body of the drum washing machine through a door hinge, so as to prevent washing water in a drum from leaking. A user can also observe a washing condition in the drum through an observing window on the door body. A door body shaft bushing of the drum washing machine is fixed directly through clamping of two engaged surfaces of a door body inner frame and a door body outer frame, causing poor stability and non-firmness. When the door body is frequently opened and closed, frequent rotation occurs among the door body outer frame, the door body inner frame and the door body shaft bushing. After the door body shaft bushing is worn, the door body shaft bushing is loosened, causing sagging of the door body and failure of opening and closing of the door body. In addition, as a volume of the washing machine is increased, the door body is also increased accordingly. The door body in the related art has insufficient strength, and is easy to cause sagging and even drop of the door body.

SUMMARY

The present disclosure provides a fixing structure of a door body shaft bushing, so as to enhance strength between a door body inner frame and a door body outer frame and firm degree of a door body shaft bushing, to further enhance stability of a door body of a drum washing machine and avoid a sagging condition of the door body.

Embodiments of the present disclosure provide a fixing structure of a door body shaft bushing, including:

a door body outer frame, a door body inner frame engaged with the door body outer frame, a door body shaft bushing arranged between the door body outer frame and the door body inner frame, and a plurality of reinforcing ribs arranged on two opposed surfaces of the door body outer frame and the door body inner frame when the door body outer frame and the door body inner frame are engaged with each other.

The plurality of reinforcing ribs are respectively arranged in a staggered manner along a radial direction and an axial direction of shaft holes of the door body shaft bushing.

The reinforcing ribs on the door body outer frame and/or the door body inner frame are in contact with the door body shaft bushing and clamp the door body shaft bushing.

In one embodiment, the plurality of reinforcing ribs include type A reinforcing ribs distributed along the axial direction of the door body shaft bushing and type B reinforcing ribs distributed along the radial direction of the door body shaft bushing, each of the type B reinforcing ribs on the door body outer frame are located between respective two adjacent type A reinforcing ribs on the door body outer frame and is connected with the respective two type A reinforcing ribs, and each of the type B reinforcing ribs on the door body inner frame are located between respective two adjacent type A reinforcing ribs on the door body inner frame and is connected with the respective two type A reinforcing ribs.

In one embodiment, a clamping portion fitted with an axial local profile of the door body shaft bushing is arranged on each of the type A reinforcing ribs on the door body outer frame and the door body inner frame. Clamping portions on two adjacent type A reinforcing ribs on the door body outer frame and the door body inner frame support and clamp the door body shaft bushing. Each of the type A reinforcing ribs on the door body outer frame is inserted into a gap between respective two adjacent type A reinforcing ribs on the door body inner frame; and each of the type A reinforcing ribs on the door body inner frame is inserted into a gap between respective two adjacent type A reinforcing ribs on the door body outer frame. In one embodiment, the type B reinforcing ribs located right above or right below the door body shaft bushing come into contact with the door body shaft bushing and clamp the door body shaft bushing.

In one embodiment, each of the type B reinforcing ribs located at both sides of the door body shaft bushing on the door body outer frame is inserted into a gap between respective two adjacent type B reinforcing ribs on the door body inner frame, and each of the type B reinforcing ribs located at both sides of the door body shaft bushing on the door body inner frame is inserted into a gap between two adjacent type B reinforcing ribs on the door body outer frame.

In one embodiment, end surfaces of free ends of the type A reinforcing ribs on the door body outer frame and the door body inner frame are on a same plane.

In one embodiment, the end surfaces of the free ends of the type A reinforcing ribs on the door body outer frame and the door body inner frame are not on the same plane.

In one embodiment, the door body outer frame and the door body inner frame are engaged with each other and then fixed through screws.

In one embodiment, a section shape of the door body shaft bushing is non-circular.

Embodiments of the present disclosure also provide a drum washing machine, including a door body. The door body is fixed by the above fixing structure of the door body shaft bushing.

In embodiments of the present disclosure, a plurality of reinforcing ribs arranged in a staggered manner are respectively arranged along the radial direction and the axial direction of the door body shaft bushing on two opposed surfaces of the door body outer frame and the door body inner frame when the door body outer frame and the door body inner frame are engaged with each other, and the reinforcing ribs on the door body outer frame and the door body inner frame are inserted into gaps of the reinforcing ribs of the opposite side to fix the door body shaft bushing, thereby enhancing the strength between the door body inner frame and the door body outer frame and the degree of firmness of the door body shaft bushing, further enhancing the stability of the door body of the drum washing machine and avoiding the sagging condition of the door body.

Figure 1:
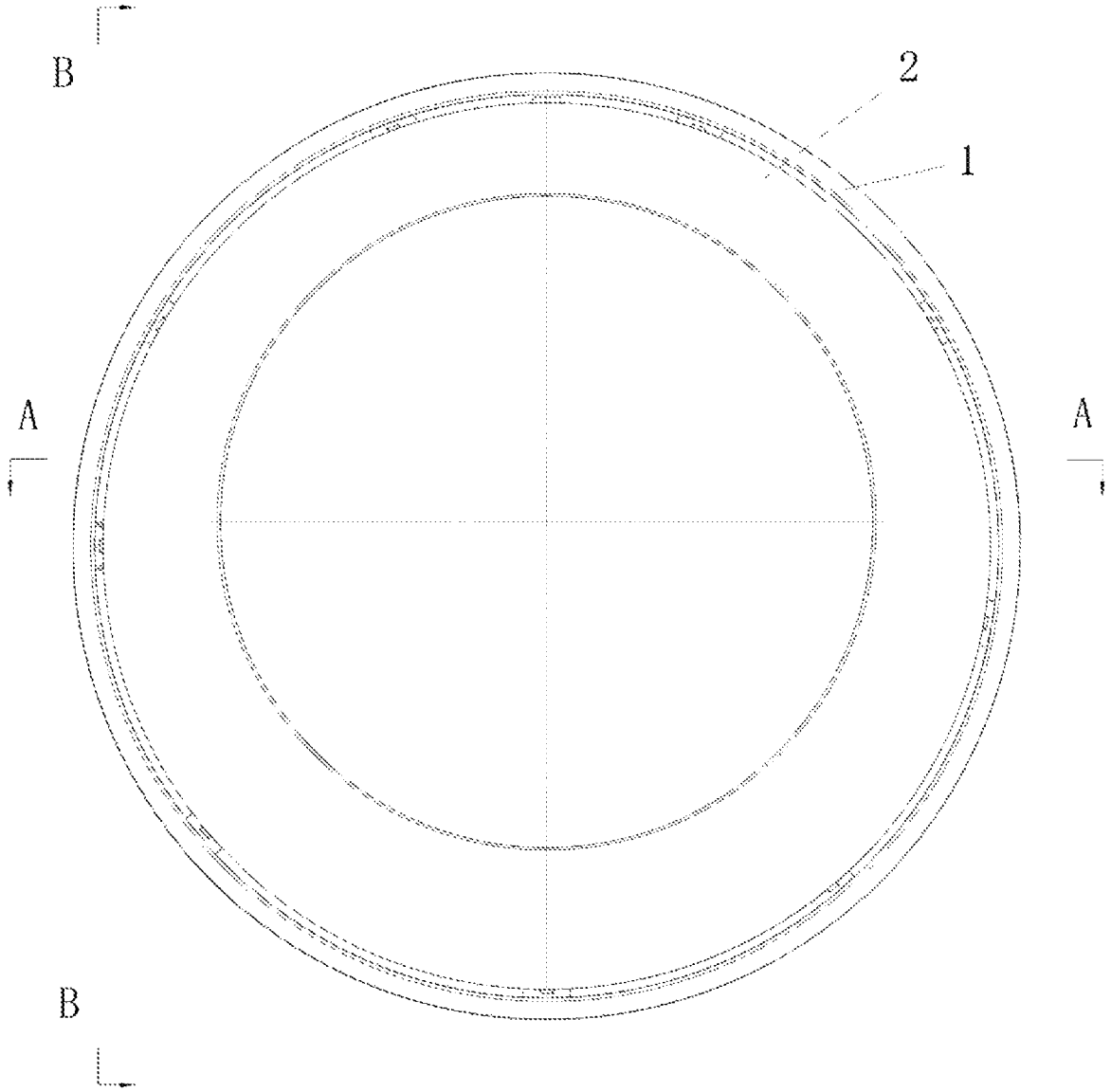
FIG. 1 is a diagram illustrating a fixing structure of a door body shaft bushing provided by an embodiment of the present disclosure.
Figure 2:
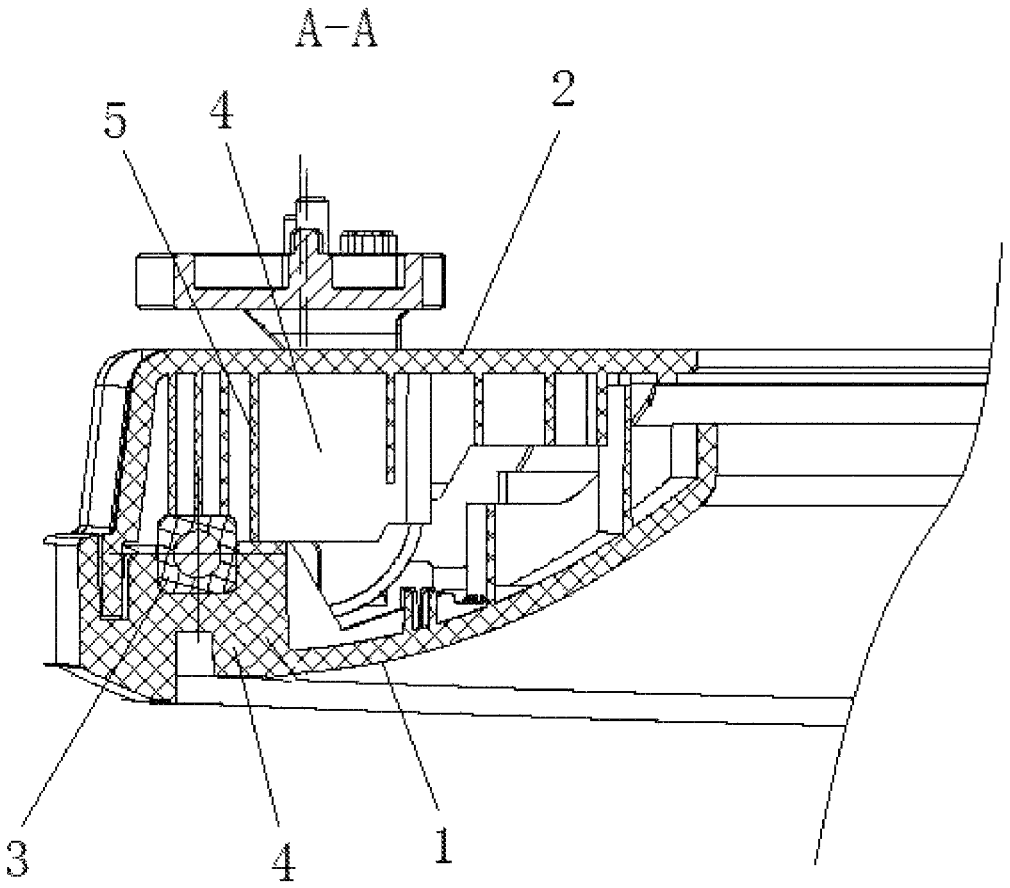
FIG. 2 is a partial section view along A-A direction of FIG. 1.

1: door body outer frame; 141: first type A reinforcing rib; 142: second type A reinforcing rib; 143: third type A reinforcing rib; 151: first type B reinforcing rib; 2: door body inner frame; 241: fourth type A reinforcing rib; 242: fifth type A reinforcing rib; 243: sixth type A reinforcing rib; 251: second type B reinforcing rib; 3: door body shaft bushing; 4: type A reinforcing rib; 5: type B reinforcing rib; and 6: clamping portion.

DETAILED DESCRIPTION

Technical solutions of the present disclosure will be described below in combination with drawings and optional embodiments. Embodiments and features in embodiments can be arbitrarily combined without conflict.

The present embodiment provides a fixing structure of a door body shaft bushing. As shown in FIG. 1 to FIG. 4, the fixing structure of the door body shaft bushing includes a door body outer frame 1 and a door body inner frame 2 engaged with the door body outer frame 1. A door body shaft bushing 3 is arranged between the door body outer frame 1 and the door body inner frame 2. A plurality of reinforcing ribs arranged in a staggered manner are respectively arranged along a radial direction and an axial direction of shaft holes of the door body shaft bushing 3 on engaged surfaces between the door body outer frame 1 and the door body inner frame 2. In one embodiment, the reinforcing ribs may be perpendicular to the engaged surfaces between the door body outer frame 1 and the door body inner frame 2. The reinforcing ribs on the door body outer frame 1 and/or the door body inner frame 2 are in contact with the door body shaft bushing 3 and clamp the door body shaft bushing 3.

Optionally, the following conditions may be included:

The reinforcing ribs are arranged on the door body outer frame 1, the reinforcing ribs are not arranged on the door body inner frame 2, and the reinforcing ribs on the door body outer frame 1 are in contact with the door body inner frame 2 and the door body shaft bushing 3 and clamp the door body shaft bushing 3.

Or, the reinforcing ribs are not arranged on the door body outer frame 1, the reinforcing ribs are arranged on the door body inner frame 2, and the reinforcing ribs on the door body outer frame 1 and the door body inner frame 2 are in contact with the door body shaft bushing 3 and clamp the door body shaft bushing 3.

Or, the reinforcing ribs are arranged on the door body outer frame 1, the reinforcing ribs are arranged on the door body inner frame 2, and the reinforcing ribs on the door body outer frame 1 and the reinforcing ribs on the door body inner frame 2 are in contact with the door body shaft bushing 3 and clamp the door body shaft bushing 3.

In the present embodiment, the reinforcing ribs include type A reinforcing ribs 4 distributed along the axial direction of the door body shaft bushing 3 and type B reinforcing ribs 5 distributed along the radial direction of the door body shaft bushing 3; each of the type B reinforcing ribs 5 on the door body outer frame 1 is located between respective two adjacent type A reinforcing ribs 4 on the door body outer frame 1 and is connected with the respective two type A reinforcing ribs 4; and each of the type B reinforcing ribs 5 on the door body inner frame 2 is located between respective two adjacent type A reinforcing ribs 4 on the door body inner frame 2 and is connected with the respective two type A reinforcing ribs 4.

Figure 5:
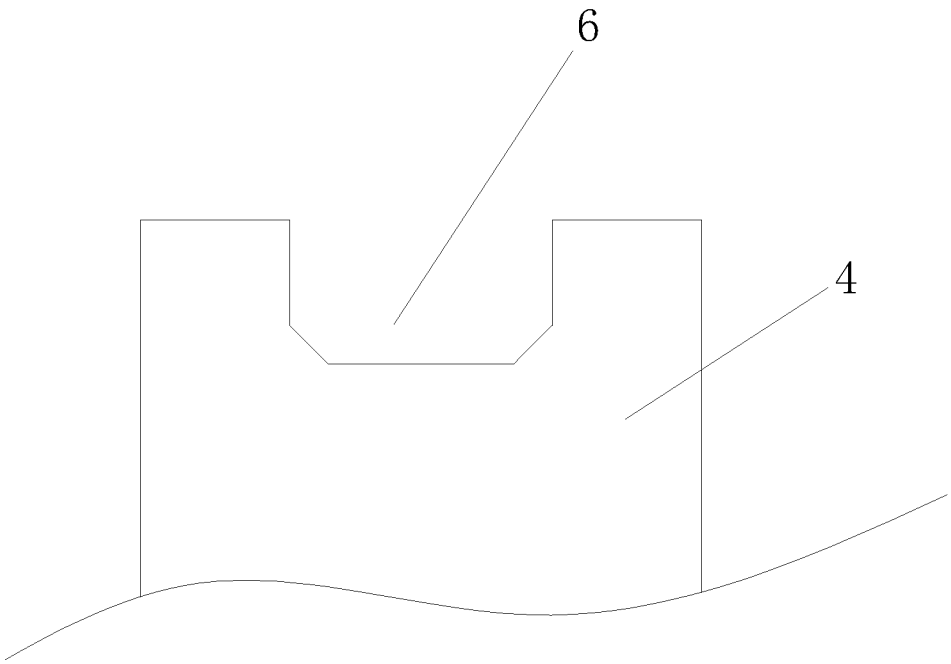
FIG. 5 is a structural diagram illustrating a clamping portion provided by an embodiment of the present disclosure.

In the present embodiment, as shown in FIG. 5, a clamping portion 6 fitted with an axial local profile of the door body shaft bushing 3 are arranged on the type A reinforcing ribs 4 on the door body outer frame 1 and/or the door body inner frame 2; clamping portions 6 on two adjacent type A reinforcing ribs 4 on the door body outer frame 1 and the door body inner frame 2 support and clamp the door body shaft bushing 3; each of the type A reinforcing ribs 4 on the door body outer frame 1 is inserted into a gap between respective two adjacent type A reinforcing ribs 4 on the door body inner frame 2; and each of the type A reinforcing ribs 4 on the door body inner frame 2 is inserted into a gap between respective two adjacent type A reinforcing ribs 4 on the door body outer frame 1.

Figure 3:
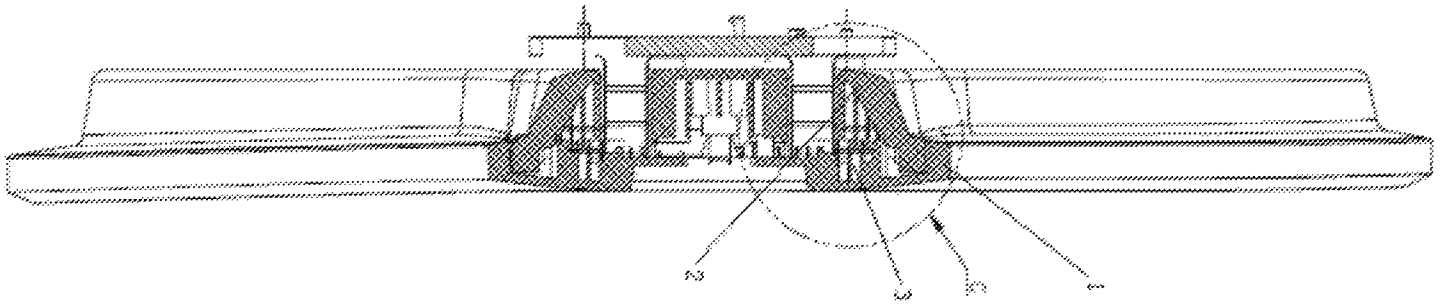
FIG. 3 is a partial section view along B-B direction of FIG. 1.
Figure 4:
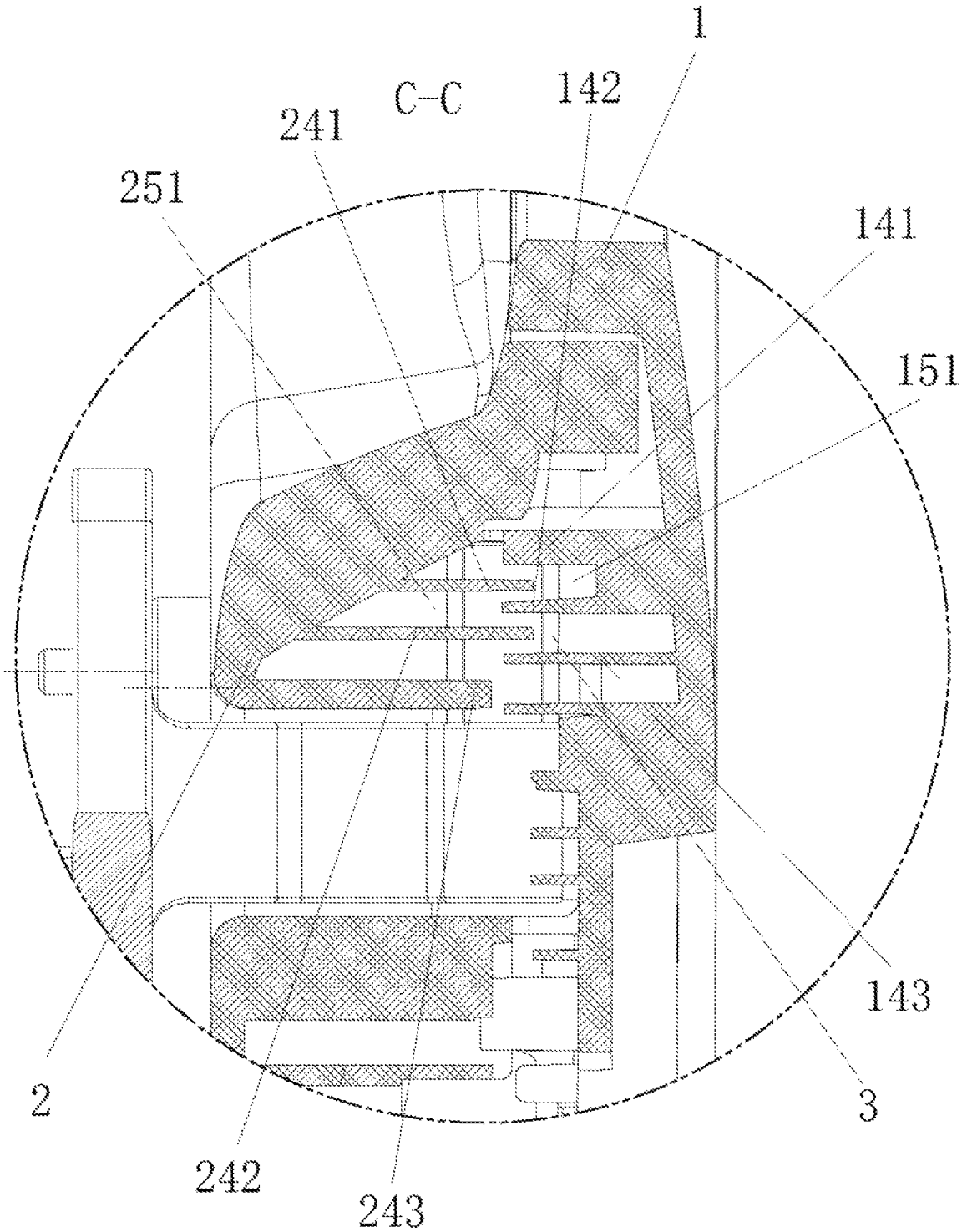
FIG. 4 is a partial enlarged view of C position in FIG. 3.

As shown in FIG. 3 and FIG. 4, the type A reinforcing ribs 4 on the door body outer frame 1 and the door body inner frame 2 are mutually staggered, and the type A reinforcing ribs 4 are distributed along the axial direction of the shaft holes in the door body shaft bushing 3. A fourth type A reinforcing rib 241 on the door body inner frame 2 is inserted into a gap between first type A reinforcing rib 141 and second type A reinforcing rib 142 on the door body outer frame 1; and a fifth type A reinforcing ribs 242 on the door body inner frame 2 is inserted into a gap between the second type A reinforcing rib 142 and a third type A reinforcing rib 143 on the door body outer frame 1. Meanwhile, the second type A reinforcing ribs 142 on the door body outer frame 1 is inserted into a gap between the fourth type A reinforcing rib 241 and the fifth type A reinforcing rib 242 on the door body inner frame 2; and the third type A reinforcing rib 143 on the door body outer frame 1 is inserted into a gap between the fifth type A reinforcing rib 242 and the sixth type A reinforcing rib 243 on the door body inner frame 2.

Figure 6:
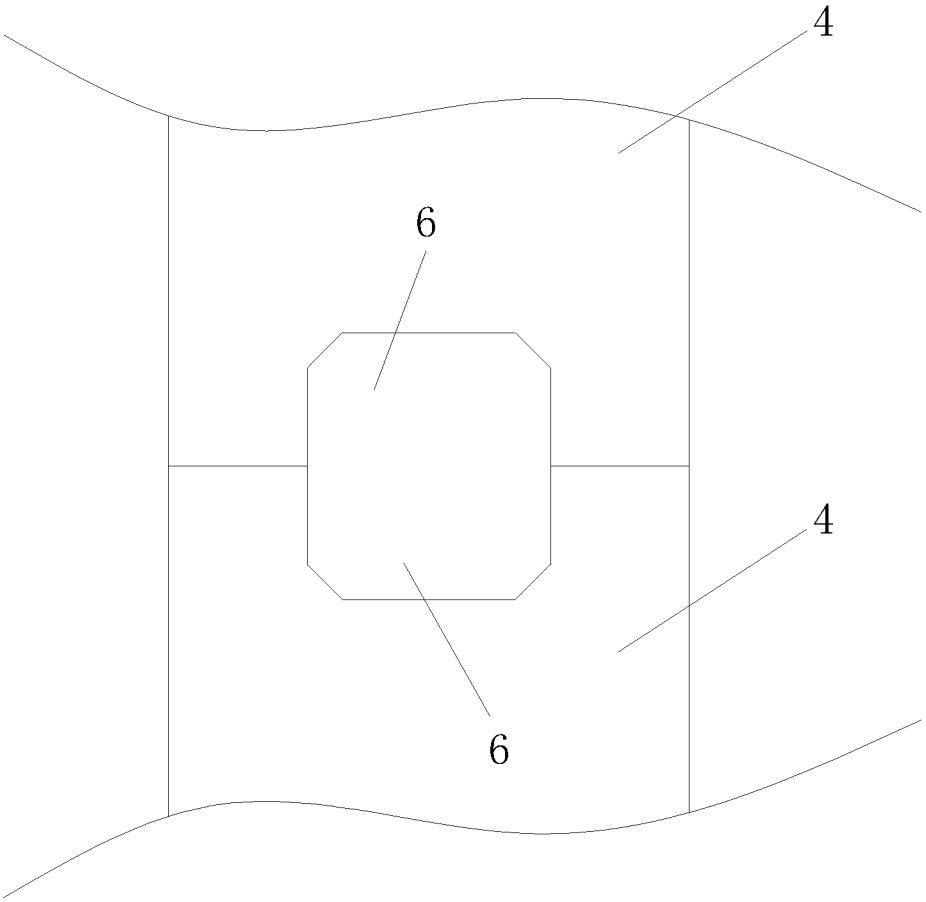
FIG. 6 is a structural diagram illustrating two clamping portions provided by an embodiment of the present disclosure.

In the present embodiment, end surfaces of free ends of the type A reinforcing ribs 4 on the door body outer frame 1 and end surfaces of free ends of the type A reinforcing ribs 4 on the door body inner frame 2 have two position relationships, i.e., on a same plane (not shown in the figure) and not on the same plane. As shown in FIG. 4, in the present embodiment, the end surfaces of the free ends of the sixth type A reinforcing ribs 243 on the door body inner frame 2 and the end surfaces of the free ends of the type A reinforcing ribs on the door body outer frame 1 are not on the same plane, and the sixth type A reinforcing ribs 243 is not inserted into a gap between respective two adjacent type A reinforcing ribs corresponding to the sixth type A reinforcing rib 243 on the door body outer frame 1. The end surfaces of the free ends of the fourth type A reinforcing ribs 241 on the door body inner frame 2 and the end surfaces of the free ends of the type A reinforcing ribs on the door body outer frame 1 are also not on the same plane, but the fourth type A reinforcing rib 241 is inserted into a gap between the first type A reinforcing rib 141 and the second type A reinforcing rib 142. As shown in FIG. 6, in the present embodiment, the end surfaces of the free ends of the type A reinforcing ribs 4 on the door body outer frame 1 and the type A reinforcing ribs 4 on the door body inner frame 2 can also be on the same plane, and this case is not shown in the figure.

In the present embodiment, the type B reinforcing ribs 5 located right above or right below the door body shaft bushing 3 are in contact with the door body shaft bushing 3 and clamp the door body shaft bushing 3. That is, the type B reinforcing ribs 5 located right above or right below the door body shaft bushing 3 mutually clamp an outer surface of the door body shaft bushing 3.

Each of the type B reinforcing ribs 5 located at both sides of the door body shaft bushing 3 on the door body outer frame 1 is inserted into a gap between respective two adjacent type B reinforcing ribs 5 on the door body inner frame 2; and each of the type B reinforcing ribs 5 located at both sides of the door body shaft bushing 3 on the door body inner frame 2 are inserted into a gap between respective two adjacent type B reinforcing ribs 5 on the door body outer frame 1. That is, the type B reinforcing ribs 5 which are mutually inserted at both sides are used to enhance degree of firmness of the door body shaft bushing 3 and the degree of firmness of the engaged inner frame and outer frame.

Two kinds of reinforcing ribs on the door body outer frame 1 and the door body inner frame 2 are engaged with each other, which enables to fix the door body shaft bushing 3 between the door body outer frame 1 and the door body inner frame 2, thereby enhancing the strength between the door body outer frame and the door body inner frame and the degree of firmness of the door body shaft bushing 3. The door body outer frame 1 and the door body inner frame 2 are engaged and then fixed through screws, so as to enhance connection strength between the door body outer frame 1 and the door body inner frame 2.

Figure 7:
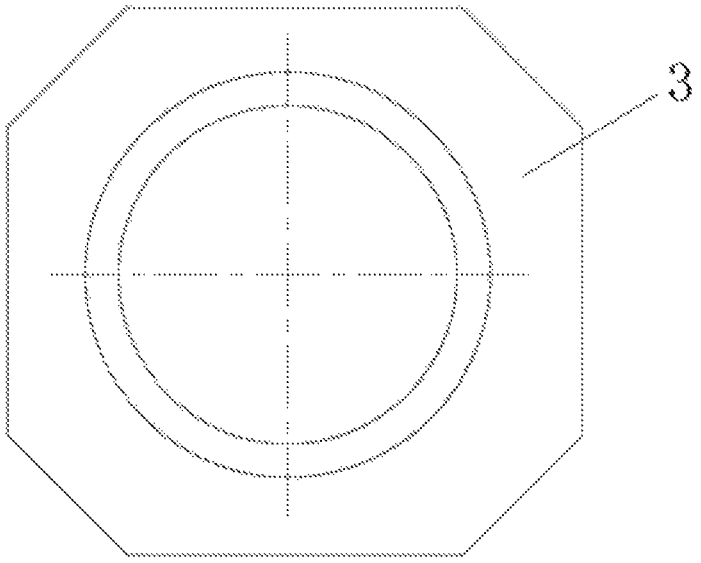
FIG. 7 is a structural diagram illustrating a door body shaft bushing with a square section provided by an embodiment of the present disclosure.
Figure 8:
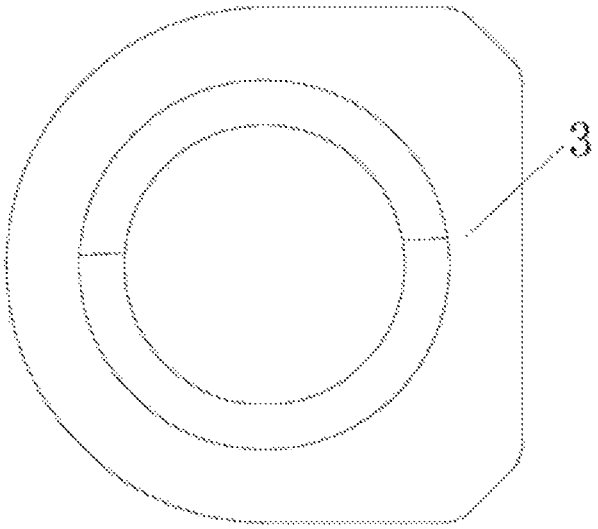
FIG. 8 is a structural diagram illustrating a door body shaft bushing with a D-shaped section provided by an embodiment of the present disclosure.

During the opening and closing of the door body, the door body shaft bushing 3 may rotate with the door body outer frame 1 or the door body inner frame 2, and may be worn, causing that fixation of the door body shaft bushing 3 is not firm and influencing stability of the door body. Therefore, a section shape of the door body shaft bushing 3 is designed to be non-circular in the present embodiment, so as to limit the rotation among the door body shaft bushing 3, the door body outer frame 1 and the door body inner frame 2. As shown in FIG. 7, the section shape of the door body shaft bushing 3 may be square in the present embodiment. As shown in FIG. 8, since the door body shaft bushing with a D-shaped section can also limit the rotation between the door body shaft bushing 3 and the door body outer frame 1 or the door body inner frame 2, the door body shaft bushing with the D-shaped section can also be adopted.

The present embodiment also provides a drum washing machine, including a door body. The door body shaft bushing 3 is fixed by the above fixing structure of the door body shaft bushing. The fixing structure is used to enhance the degree of firmness of the door body shaft bushing 3 and the connection strength between the door body outer frame and the door body inner frame, so as to further enhance the stability of the door body of the drum washing machine and prevent sagging of the door body of the drum washing machine.

Above embodiments of the present disclosure are only examples to clearly describe the present disclosure, not used to limit implementation modes of the present disclosure. For those ordinary skilled in the art, other variations or changes of different forms can also be made on the basis of the above illustration. It is unnecessary and impossible to list all implementation modes.

What is claimed is:

1. A fixing structure of a door body shaft bushing, comprising:

a door body outer frame, a door body inner frame engaged with the door body outer frame, the door body shaft bushing arranged between the door body outer frame and the door body inner frame, and a plurality of reinforcing ribs arranged on two opposed surfaces of the door body outer frame and the door body inner frame when the door body outer frame and the door body inner frame are engaged with each other, wherein the plurality of reinforcing ribs of the door body outer frame and the door body inner frame are respectively arranged in a staggered manner along a radial direction and an axial direction of shaft holes of the door body shaft bushing;

the reinforcing ribs on at least one of the door body outer frame and the door body inner frame are in contact with the door body shaft bushing and clamp the door body shaft bushing; and the plurality of reinforcing ribs of the door body outer frame and the door body inner frame comprise first reinforcing ribs distributed along the axial direction of the door body shaft bushing and second reinforcing ribs distributed along the radial direction of the door body shaft bushing, wherein each of the second reinforcing ribs on the door body outer frame is located between respective two adjacent first reinforcing ribs on the door body outer frame and is connected with the respective two first reinforcing ribs; and each of the second reinforcing ribs on the door body inner frame is located between respective two adjacent first reinforcing ribs on the door body inner frame and is connected with the respective two first reinforcing ribs.

2. The fixing structure of the door body shaft bushing according to claim 1, wherein a clamping portion fitted with an axial local profile of the door body shaft bushing is arranged on each of the first reinforcing ribs on the door body outer frame and the door body inner frame; wherein clamping portions on two adjacent first reinforcing ribs on the door body outer frame and the door body inner frame support and clamp the door body shaft bushing; wherein each of the first reinforcing ribs on the door body outer frame is inserted into a gap between respective two adjacent first reinforcing ribs on the door body inner frame; and wherein each of the first reinforcing ribs on the door body inner frame is inserted into a gap between the respective two adjacent first reinforcing ribs on the door body outer frame.

3. The fixing structure of the door body shaft bushing according to claim 1, wherein the second reinforcing ribs of the door body outer frame and the door body inner frame located above or below the door body shaft bushing are in contact with the door body shaft bushing and clamp the door body shaft bushing.

4. The fixing structure of the door body shaft bushing according to claim 1, wherein each of the second reinforcing ribs located at both sides of the door body shaft bushing on the door body outer frame is inserted into a gap between respective two adjacent second reinforcing ribs on the door body inner frame; and each of the second reinforcing ribs located at both sides of the door body shaft bushing on the door body inner frame is inserted into a gap between respective two adjacent second reinforcing ribs on the door body outer frame.

5. The fixing structure of the door body shaft bushing according to claim 1, wherein end surfaces of free ends of the first reinforcing ribs on the door body outer frame and the door body inner frame are on a same plane.

6. The fixing structure of the door body shaft bushing according to claim 1, wherein end surfaces of free ends of the first reinforcing ribs on the door body outer frame and the door body inner frame are not on a same plane.

7. The fixing structure of the door body shaft bushing according to claim 1, wherein the door body outer frame and the door body inner frame are fixed through screws.

8. The fixing structure of the door body shaft bushing according to claim 1, wherein a section shape of the door body shaft bushing is non-circular.

9. A drum washing machine, comprising a door body, wherein the door body is fixed by a fixing structure of a door body shaft bushing, wherein the fixing structure of the door body shaft bushing comprises:

a door body outer frame, a door body inner frame engaged with the door body outer frame, the door body shaft bushing arranged between the door body outer frame and the door body inner frame, and a plurality of reinforcing ribs arranged on two opposed surfaces of the door body outer frame and the door body inner frame when the door body outer frame and the door body inner frame are engaged with each other, wherein the plurality of reinforcing ribs of the door body outer frame and the door body inner frame are respectively arranged in a staggered manner along a radial direction and an axial direction of shaft holes of the door body shaft bushing;

the reinforcing ribs on at least one of the door body outer frame and the door body inner frame are in contact with the door body shaft bushing and clamp the door body shaft bushing; and the plurality of reinforcing ribs of the door body outer frame and the door body inner frame comprise type A reinforcing ribs distributed along the axial direction of the door body shaft bushing and type B reinforcing ribs distributed along the radial direction of the door body shaft bushing, wherein each of the type B reinforcing ribs on the door body outer frame is located between respective two adjacent type A reinforcing ribs on the door body outer frame and is connected with the respective two type A reinforcing ribs; and each of the type B reinforcing ribs on the door body inner frame is located between respective two adjacent type A reinforcing ribs on the door body inner frame and is connected with the respective two type A reinforcing ribs.

10. The fixing structure of the door body shaft bushing according to claim 9, wherein a section shape of the door body shaft bushing is non-circular.

11. The fixing structure of the door body shaft bushing according to claim 2, wherein a section shape of the door body shaft bushing is non-circular.

12. The fixing structure of the door body shaft bushing according to claim 3, wherein a section shape of the door body shaft bushing is non-circular.

13. The fixing structure of the door body shaft bushing according to claim 4, wherein a section shape of the door body shaft bushing is non-circular.

14. The fixing structure of the door body shaft bushing according to claim 5, wherein a section shape of the door body shaft bushing is non-circular.

15. The fixing structure of the door body shaft bushing according to claim 6, wherein a section shape of the door body shaft bushing is non-circular.

16. The fixing structure of the door body shaft bushing according to claim 7, wherein a section shape of the door body shaft bushing is non-circular.

* * * * *